US012745856B2

(12) United States Patent
Bryan

(10) Patent No.: US 12,745,856 B2
(45) Date of Patent: Sep. 29, 2026

(54) COOLING SEAT COVER SYSTEMS AND METHODS

(71) Applicant: Jonathon Mark Bryan, Denver, CO (US)

(72) Inventor: Jonathon Mark Bryan, Denver, CO (US)

( * ) Notice: Subject to any disclaimer, the term of this patent is extended or adjusted under 35 U.S.C. 154(b) by 34 days.

(21) Appl. No.: 18/777,370

(22) Filed: Jul. 18, 2024

(65) Prior Publication Data

US 2025/0089909 A1 Mar. 20, 2025

Related U.S. Application Data

(60) Provisional application No. 63/583,727, filed on Sep. 19, 2023.

(51) Int. Cl.
*A47C 31/11* (2006.01)

(52) U.S. Cl.
CPC ..... *A47C 31/11* (2013.01)

(58) Field of Classification Search
CPC ..... A47C 7/0213; A47C 7/74; A47C 31/11; A47C 31/113; B60N 2/60; B60N 2/7005; B60N 2/5692
USPC ..... 297/219.1, 180.11, 180.1
See application file for complete search history.

(56) References Cited

U.S. PATENT DOCUMENTS 2,904,103 A * 9/1959 Nail ..... B60N 2/60 297/229
4,604,987 A * 8/1986 Keltner ..... A47C 1/16 5/653
4,781,413 A * 11/1988 Shumack, Jr. ..... A47C 7/021 297/DIG. 3
4,997,230 A * 3/1991 Spitalnick ..... A47C 7/74 297/180.13
5,110,219 A * 5/1992 Lopes ..... A45C 9/00 5/419
5,297,304 A * 3/1994 O'Sullivan ..... A47C 7/46 5/636
5,403,065 A * 4/1995 Callerio ..... B64G 6/00 297/180.14
5,411,318 A * 5/1995 Law ..... A47C 7/74 297/452.45
5,613,730 A * 3/1997 Buie ..... B60N 2/60 297/180.12
5,833,309 A 11/1998 Schmitz
6,079,784 A * 6/2000 Peachey ..... B60N 2/663 297/284.7

(Continued)

OTHER PUBLICATIONS

International Search Report and Written Opinion received for PCT Patent Application No. PCT/US24/47473, mailed on Feb. 27, 2025, 14 pages.

*Primary Examiner* — Jose V Chen

(57) ABSTRACT

A seat cover system for detachably coupling to a seat includes a main body and a cooling pack. The main body includes a top end, a bottom end, a first side, and a second side, the first side including a first gusset and the second side including a second gusset. The cooling pack is carried in the main body. The seat cover system is configurable from a rolled configuration to a seat configuration and vice versa, and the first gusset and the second gusset are configured to inhibit the seat cover system from reconfiguring from the seat configuration to a flat configuration.

11 Claims, 9 Drawing Sheets

(56) References Cited

U.S. PATENT DOCUMENTS 6,132,455 A * 10/2000 Shang ..... A47C 7/744 5/655.5
6,135,635 A * 10/2000 Miller ..... A47C 31/11 297/229
6,164,719 A * 12/2000 Rauh ..... H05B 3/34 297/180.12
6,241,188 B1 * 6/2001 Simpson ..... B60N 2/6027 244/122 R
6,334,650 B1 * 1/2002 Chien-Chuan ..... A47C 7/46 297/230.11
6,422,032 B1 * 7/2002 Greene ..... F25D 3/08 62/530
6,659,551 B1 12/2003 Arenas
6,848,746 B2 * 2/2005 Gentry ..... A47C 7/748 297/229
7,070,231 B1 * 7/2006 Wong ..... B60N 2/5635 297/180.13
7,517,013 B1 * 4/2009 Lowe ..... A47C 7/742 297/188.2
8,123,290 B1 * 2/2012 Aiken ..... A47C 31/11 297/229
8,276,986 B2 * 10/2012 Kim ..... A47C 7/021 297/452.45
8,556,337 B1 * 10/2013 Cornitius-Cary ..... A47C 7/746 297/188.2
8,757,723 B1 * 6/2014 Faust ..... B60N 2/995 297/423.39
9,549,617 B1 * 1/2017 Deluca ..... A47C 7/746
10,123,632 B2 * 11/2018 Whitted ..... A47C 1/02
10,299,600 B2 * 5/2019 Cribbs ..... A47C 7/021
D1,054,575 S * 12/2024 Moyles ..... D24/206
12,252,203 B1 * 3/2025 Hanagan ..... B62J 33/00
12,263,813 B1 * 4/2025 Hsu ..... B60R 7/043
D1,086,975 S * 8/2025 Hsu ..... D12/416
2007/0261171 A1 * 11/2007 Williams ..... A47C 7/0213 5/636
2007/0271704 A1 * 11/2007 Breeland ..... A61G 5/1091 5/653
2009/0007389 A1 1/2009 Pfannkuch
2010/0140995 A1 * 6/2010 Everett ..... A47C 31/11 297/230.1
2011/0078853 A1 4/2011 McCarthy
2011/0127815 A1 * 6/2011 Nickerson ..... A47C 7/0213 297/219.1
2011/0248532 A1 * 10/2011 Kim ..... B60N 2/56 297/180.11
2012/0242126 A1 * 9/2012 Burns ..... A47C 31/11 297/228.12
2014/0008945 A1 * 1/2014 Widmann ..... A47C 7/746 297/180.11
2015/0097402 A1 * 4/2015 Bee ..... A47C 31/113 297/229
2016/0051052 A1 * 2/2016 Leff ..... A47C 7/0213 297/354.1
2016/0338502 A1 * 11/2016 Markowitz ..... A47C 31/11
2022/0330712 A1 * 10/2022 Adams ..... A47C 31/11
2022/0395117 A1 * 12/2022 Bair ..... A47C 31/11

* cited by examiner

COOLING SEAT COVER SYSTEMS AND METHODS

CROSS-REFERENCE TO RELATED APPLICATION

The present application claims priority to and the benefit of, under 35 U.S.C. § 119(e), U.S. Provisional Patent Application No. 63/583,727, filed Sep. 19, 2023, which is hereby incorporated by reference.

BACKGROUND

Attending outdoor activities in warmer weather also typically means that individuals must tolerate excessive heat from direct sunlight and ambient temperature. This can lead to an individual being uncomfortable, cause excessive sweating, and in extreme cases it can also present safety issues. Relatedly, seats in various outdoor settings, such as stadiums, amphitheaters, seats within motor vehicles, portable chairs, and the like, are typically relatively uncomfortable in warm weather due to being unsuitable for maintaining a reasonable temperature for users. Some settings, such as club level seating at sports stadiums, include luxury seats in view of these issues, although the relatively high costs of such seats are often passed along to customers. Accordingly, improvements are needed so that individuals can sit comfortably and regulate their body temperature while enjoying outdoor activities in warmer temperatures.

SUMMARY

According to one embodiment ("Embodiment 1"), a seat cover system for detachably coupling to a seat includes a main body and a cooling pack. The main body includes a top end, a bottom end, a first side, and a second side, the first side including a first gusset and the second side including a second gusset. The cooling pack is carried in the main body. The seat cover system is configurable from a rolled configuration to a seat configuration and vice versa, and the first gusset and the second gusset are configured to inhibit the seat cover system from reconfiguring from the seat configuration to a flat configuration.

According to another embodiment ("Embodiment 2"), the seat cover system of Embodiment 1 further includes a plurality of straps coupled to the main body.

According to another embodiment ("Embodiment 3"), the seat cover system of Embodiment 2 wherein the plurality of straps are configured to extend around the seat to couple the seat cover system to the seat.

According to another embodiment ("Embodiment 4"), the seat cover system of Embodiment 2 further includes a plurality of swivel buckles coupling the plurality of straps to the main body.

According to another embodiment ("Embodiment 5"), the seat cover system of Embodiment 1 wherein the main body further includes a back portion and a seat portion defining an angle therebetween in a range of 100 degrees to 120 degrees.

According to another embodiment ("Embodiment 6"), the seat cover system of Embodiment 1 further includes an insulating pouch disposed in the main body and carrying the cooling pack.

According to another embodiment ("Embodiment 7"), a method of coupling a seat cover system to a seat, the seat cover system including a main body, a plurality of straps coupled to the main body, and a cooling pack carried in the main body, includes: positioning the seat cover system in a rolled configuration; coupling the plurality of straps to each other to maintain the seat cover system in the rolled configuration; decoupling the plurality of straps from each other; repositioning the seat cover system from the rolled configuration to a seat configuration; and coupling the plurality of straps to each other and positioning the plurality of straps around the plurality of straps around the seat.

According to another embodiment ("Embodiment 8"), the method of Embodiment 7 wherein the plurality of straps includes a plurality of upper straps and a plurality of lower straps, coupling the plurality of straps to each other to maintain the seat cover system in the rolled configuration includes coupling each upper strap of the plurality of upper straps to one of the lower straps of the plurality of lower straps, and coupling the plurality of straps to each other and positioning the plurality of straps around the seat includes coupling the plurality of upper straps to each other and positioning the plurality of upper straps around the seat.

According to another embodiment ("Embodiment 9"), the method of Embodiment 7 wherein the seat cover system further includes a plurality of swivel buckles coupling the plurality of straps to the main body.

According to another embodiment ("Embodiment 10"), the method of Embodiment 9 further includes: (1) after decoupling the plurality of straps from each other and (2) before coupling the plurality of straps to each other and positioning the plurality of straps around the plurality of straps around the seat, pivoting the plurality of straps relative to the main body via the plurality of swivel buckles.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 2:
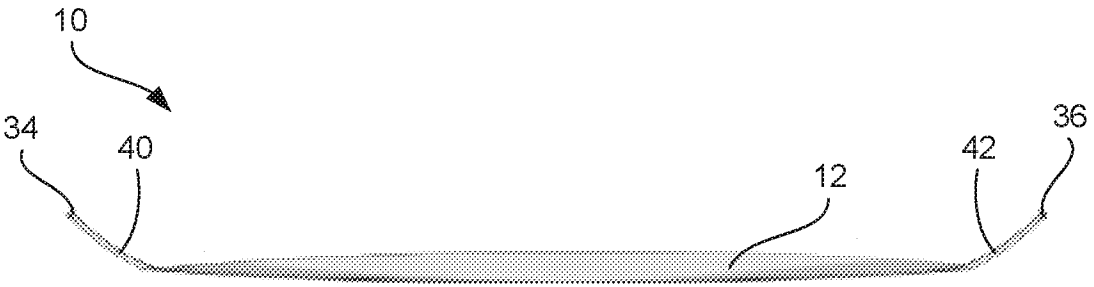
FIG. 2 is an end view of the seat cover system of FIG. 1.

It should be understood that the drawings are intended facilitate understanding of exemplary embodiments of the present invention are not necessarily to scale.

DETAILED DESCRIPTION OF THE DRAWINGS

The following description refers to the accompanying drawings which show specific embodiments. Although specific embodiments are shown and described, it is to be understood that additional and/or alternative features are employed in other embodiments. The following detailed description is not to be taken in a limiting sense, and the scope of the claimed invention is defined by the appended claims and their equivalents.

It should be understood that like reference numerals are intended to identify the same structural components, elements, portions, or surfaces consistently throughout the several drawing figures, as such components, elements, portions, or surfaces may be further described or explained by the entire written specification, of which this detailed description is an integral part. Unless otherwise indicated, the drawings are intended to be read (for example, cross-hatching, arrangement of parts, proportion, degree, etc.) together with the specification, and are to be considered a portion of the written description.

FIGS. 1-15 illustrate a seat cover system 10, or components thereof, according to an exemplary embodiment of the present disclosure. The seat cover system 10 is configured to be detachably coupled to a seat, more specifically and for example, a stadium seat, motorized vehicle seat, or any other seat with a back to which straps can be attached. The seat cover system 10 may have dimensions of about 1010 cm×450 cm×10 cm, or various other dimensions. In certain embodiments, the seat cover system 10 includes a main body 12, which may be constructed of pack cloth or other weather-resistant material, a zipper 14 (FIG. 1), such as a YYK #5 zipper, a plurality of straps 16 (FIGS. 6-8), such as straps constructed of a 1.5" or 38 mm black polyester webbing, webbing components 18, such as a 10 mm polyester webbing, an upper flap 20 (FIGS. 3-5), which may be a silver foil layer, a refreezable or recoolable cooling pack 22 (FIG. 13), more specifically a flexible ice pack, a zipper pull 24 (FIG. 14), coupling buckles 26 (FIGS. 6-8, 11*a*, and 11*b*), and swivel connectors or buckles 28 (FIGS. 6-8 and 11*c*). According to some embodiments, stitching may match the main body 12 of the seat cover system 10 and may have eight stitches per inch. The stitching may be nylon, and the seat cover system 10 may be individually packed in a poly bag.

Figure 1:
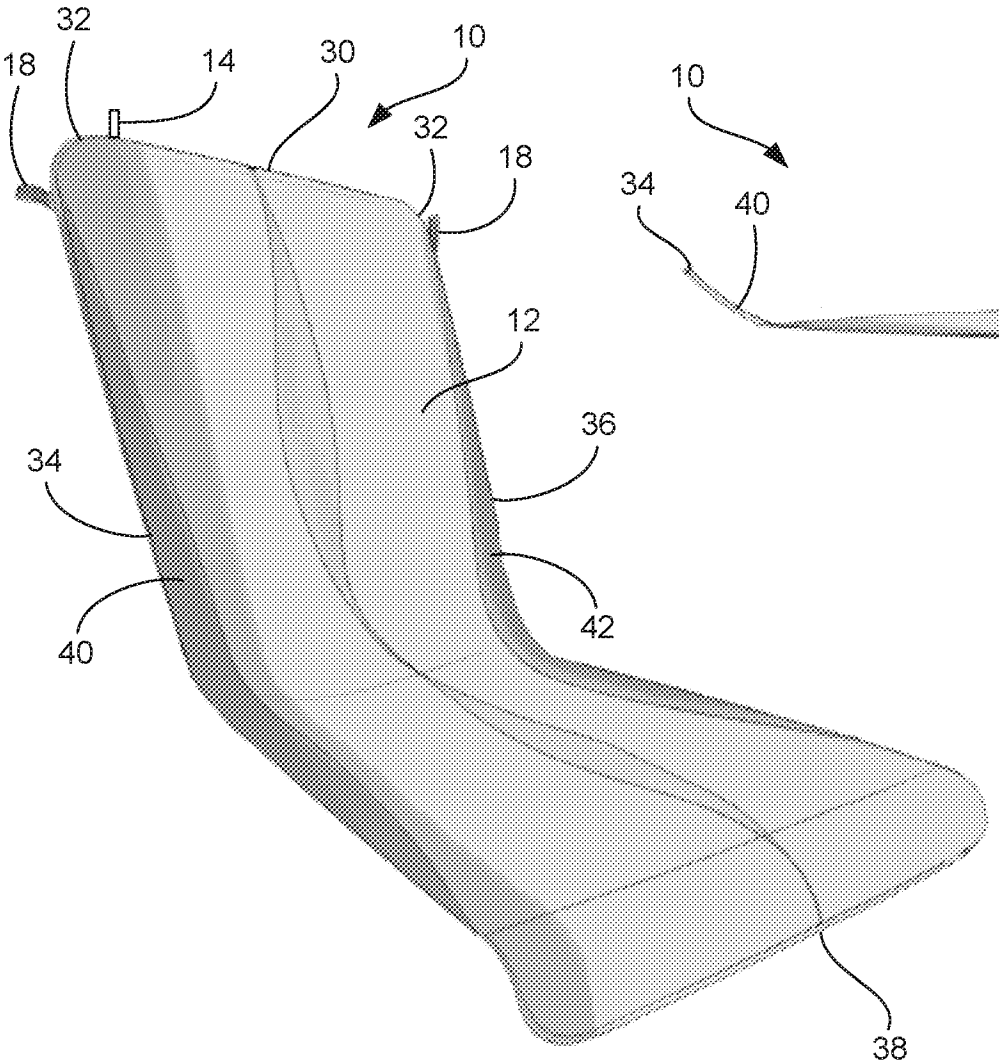
FIG. 1 is a front perspective view of a seat cover system, according to an exemplary embodiment of the present disclosure, in a seat configuration.

Referring specifically to FIG. 1, the seat cover system 10 is shown in a "use" or "seat" configuration (that is, in the general shape of a seat). Illustratively, the zipper 14 of the seat cover system 10 is disposed at a top end 30 of the seat cover system 10. Alternatively, the zipper 14 may be disposed on a side of the seat cover system 10. The zipper 15 facilitates removing the cooling pack 22 and an insulating pouch (shown elsewhere) from the system 10, cooling the cooling pack 22, and subsequently reinserting the cooling pack 22 and the insulating pouch. The webbing components 18 are disposed near corners 32 of the seat cover system 10. Referring specifically to FIGS. 1 and 2, a first or left side 34 and a second or right side 36 of the seat cover system 10, which extend between the top end 30 and an opposite bottom end 38, include a first or left gusset 40 and a second or right gusset 42, respectively, that inhibit the seat cover system 10 from reconfiguring from the seat configuration to a flat configuration (that is, a configuration in which the seat cover system 10 is generally disposed in a single plane), for example, under its own weight. The left gusset 40 and the right gusset 42 also facilitate identifying the top and bottom orientations of the seat cover system 10.

Figure 5:
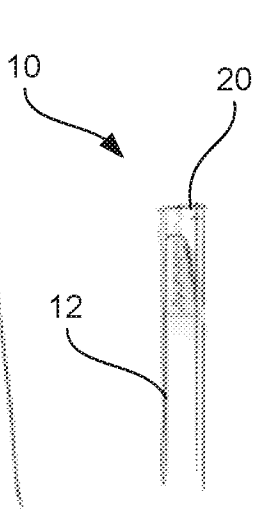
FIG. 5 is a partial side view of the seat cover system of FIG. 1.
Figure 4:
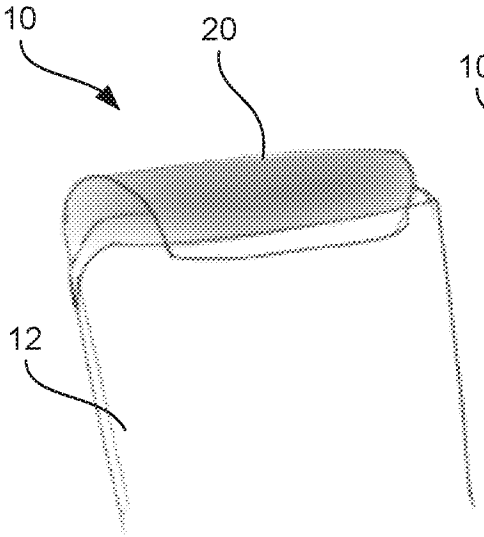
FIG. 4 is a partial front perspective view of the seat cover system of FIG. 1.
Figure 3:
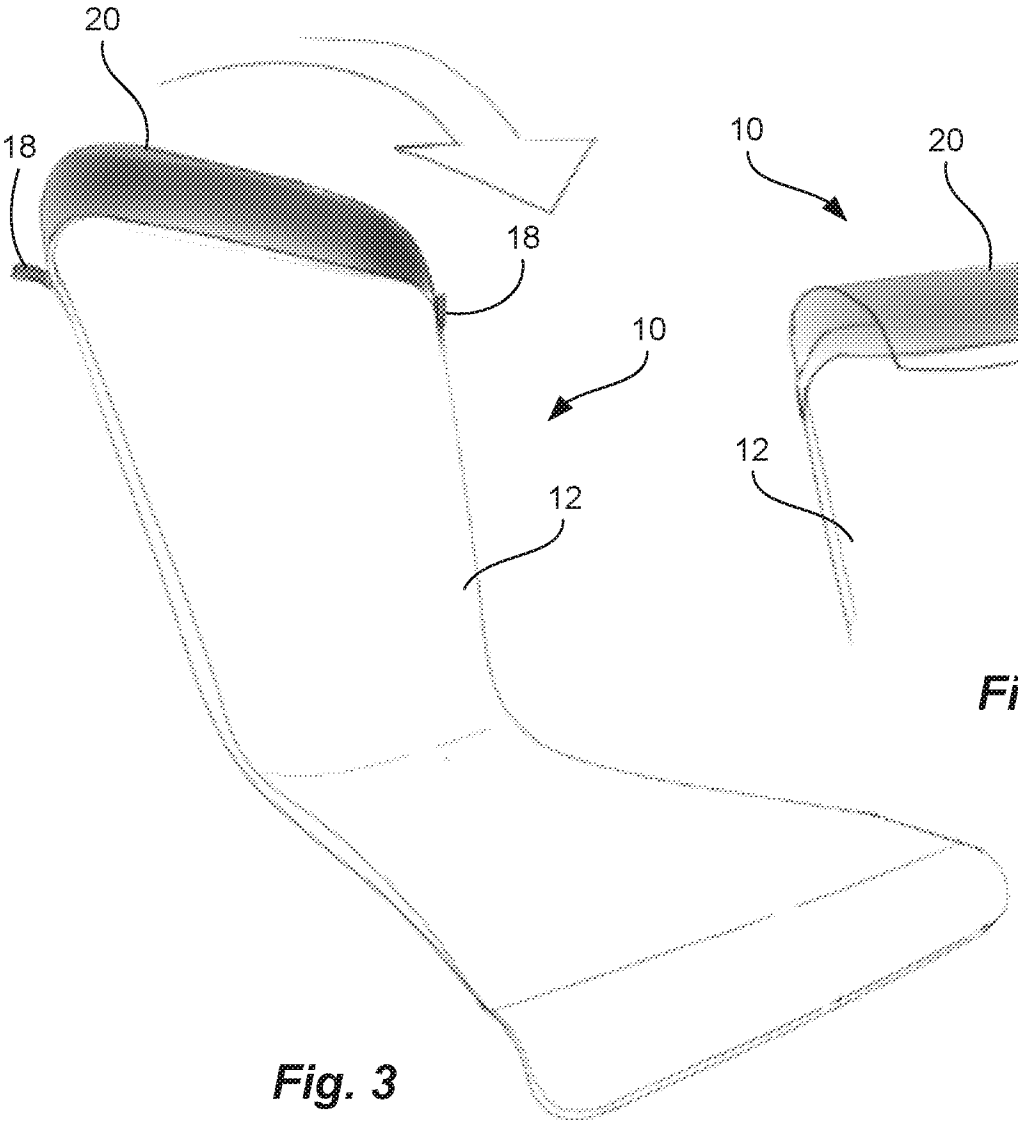
FIG. 3 is another front perspective view of the seat cover system of FIG. 1.

Referring specifically to FIGS. 3-5, the upper flap 20 is disposed at or near the top end 30 of the seat cover system 10. The upper flap 20 is foldable over the top end 30 to make an envelope for the cooling pack 22. More specifically, the upper flap 20 extends, for example, by approximately 100 mm, past the top end 30 of the seat cover system 10 and rolls forward to facilitate insulating the cooling pack 22.

Figures 6, 7, 8:
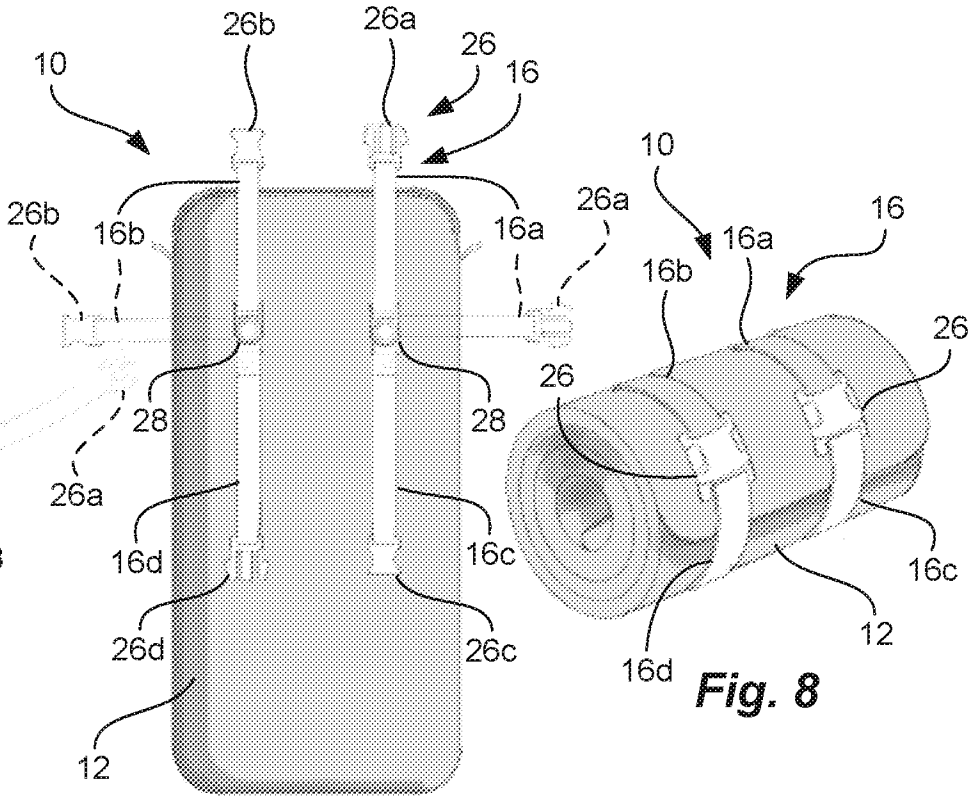
FIG. 6 is a rear perspective view of the seat cover system of FIG. 1.
FIG. 7 is a rear view of the seat cover system of FIG. 1.
FIG. 8 is a rear perspective view of the seat cover system of FIG. 1 in a rolled configuration.

Referring specifically to FIGS. 6-8, rear views of the seat cover system 10 are illustrated. The swivel buckles 28 couple the straps 16 to the main body 12. The swivel buckles 28 also permit the straps 16 to transition, more specifically pivot, from a first configuration to a second configuration and vice versa. In the first configuration (generally as shown in solid lines in FIGS. 6 and 7), the straps 16 may be coupled to form vertical loops and thereby act as compression/shoulder straps (stated another way, the straps 16 occupy a carrying or arm attachment configuration). In the second configuration (generally as shown in phantom lines in FIGS. 6 and 7), the straps 16 may be coupled to form a horizontal loop and thereby act as securement straps and attach the seat cover system 10 to a seat (stated another way, the straps 16 occupy seat attachment configuration), such as stadium seats, automobile seats, other outdoor chairs, or other types of seats. As illustrated, the coupling buckles 26 on opposite upper straps 16*a*, 16*b* are reversed (that is, one upper strap 16*a* includes a male buckle 26*a* and one upper strap 16*b* includes a female buckle 26*b*) to permit the upper straps 16*a*, 16*b* to be selectively coupled to each other in the seat attachment configuration. Also as illustrated, the coupling buckles 26 on lower straps 16*c*, 16*d* are reversed relative to the upper straps 16*a*, 16*b* on the same side of the cover 10 (that is, one lower strap 16*c* includes a female buckle 26*c* and one lower strap 16*d* includes a male buckle 26*d*) to permit the straps 16 on the same side of the cover system 10 to be coupled to each other when the cover system 10 occupies the arm attachment configuration or when the cover system 10 occupies a rolled configuration (FIG. 8).

Figure 9B:
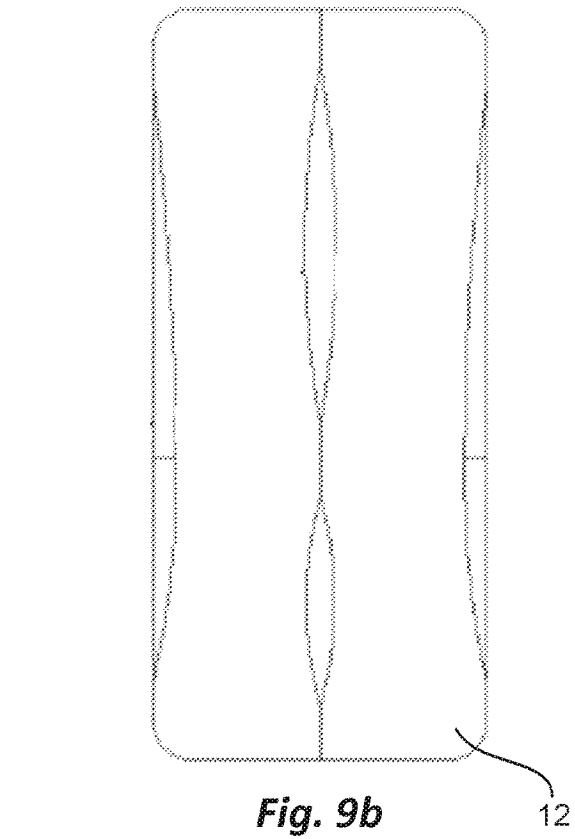
FIG. 9*b* is a rear view of the seat cover system of FIG. 1 in an inverted configuration.
Figure 9A:
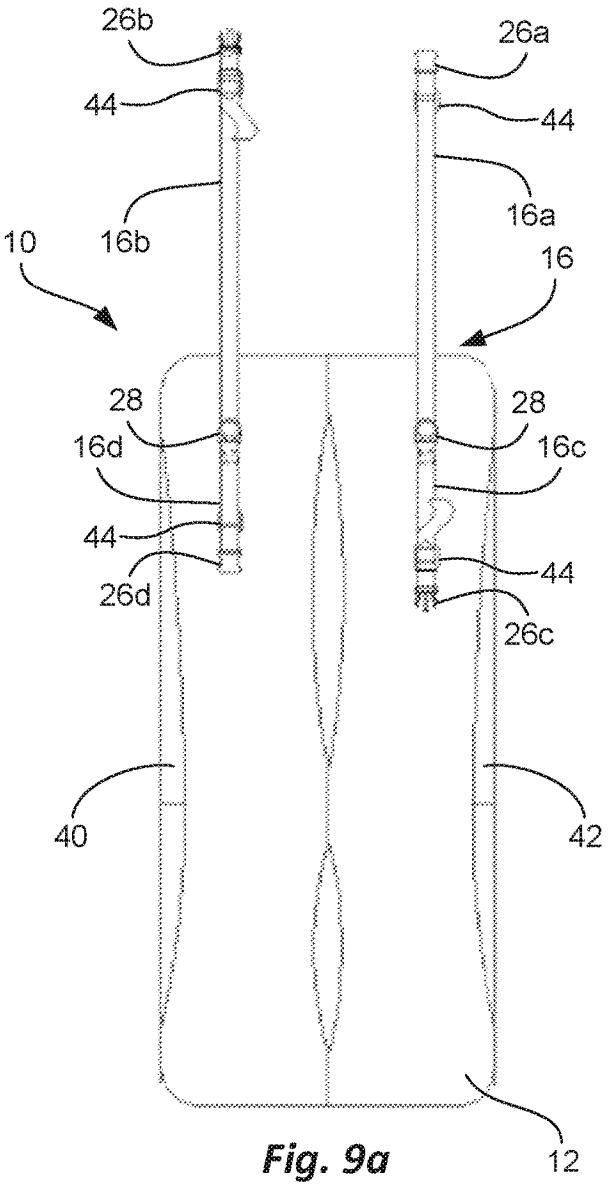
FIG. 9*a* is another rear view of the seat cover system of FIG. 1 in a flattened configuration.

FIG. 9*a* illustrates a rear view of the seat cover system 10 in a flat configuration, and FIG. 9B illustrates a rear view of the seat cover system 10 in an inverted (stated another way, inside-out) configuration. The seat cover system 10 may have a height of about 1010 cm, a width of about 450 cm, and a distance between the straps 16 of about 240 cm. In some embodiments, the rear side of the seat cover system 10 has a double layer of insulation or bubble wrap foil, and the front side of the seat cover system 10 has a single layer of insulation.

Figure 10:
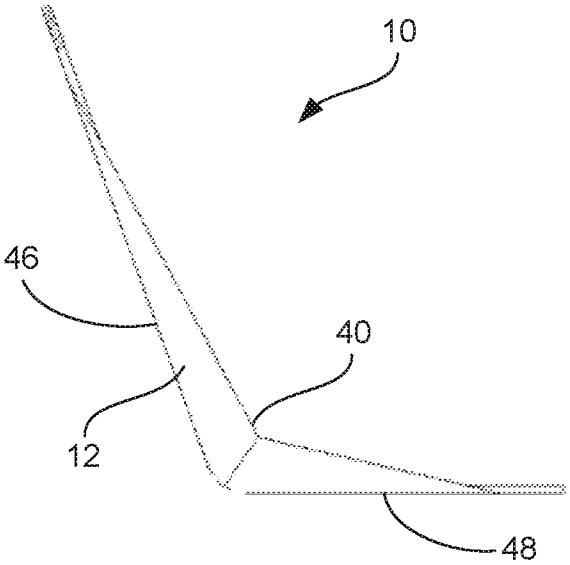
FIG. 10 is a side view of the seat cover system of FIG. 1 in the seat configuration.

FIG. 10 illustrates a side view of the seat cover system 10 in the seat configuration. In some embodiments and as illustrated, adjusters 44 are coupled to the straps 16 and facilitate adjusting the length of the straps 16. In some embodiments, the depth of the seat cover system 10 has a depth of about 10 cm. A back portion 46 and a seat portion 48 of the seat cover system 10 form an angle therebetween, which may be in a range of 100 degrees to 120 degrees, more specifically 105 degrees to 115 degrees, and even more specifically about 110 degrees. The back portion 46 may have a height of about 605 cm and the seat portion 48 may have a length of about 405 cm.

Figure 12:
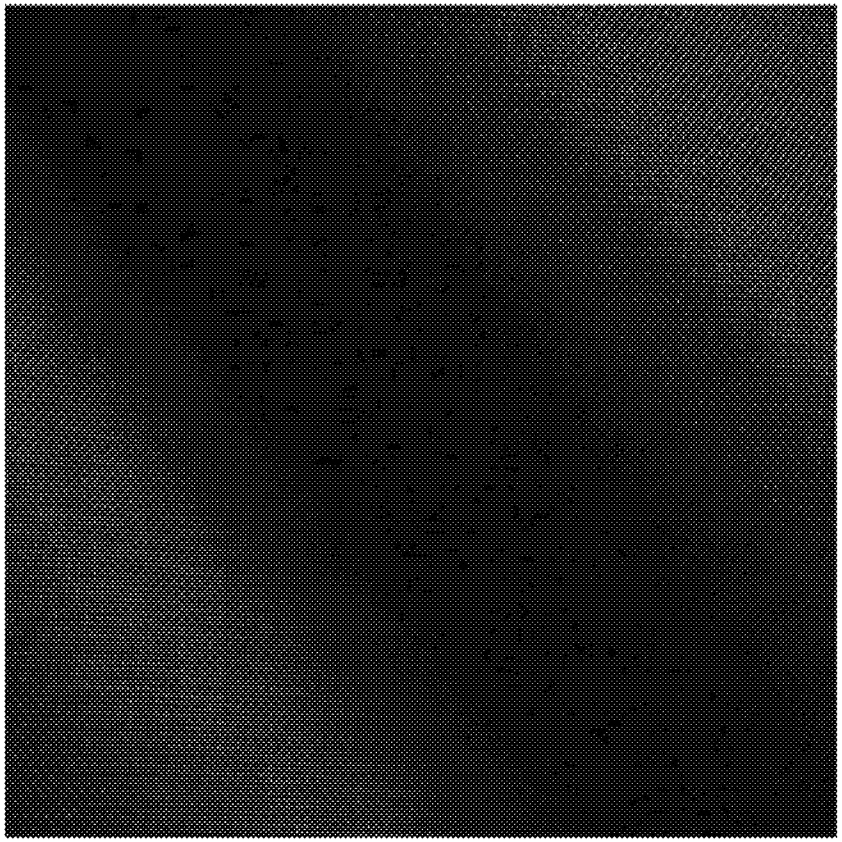
FIG. 12 is a front view of a main body of the seat cover system of FIG. 1.
Figure 11B:
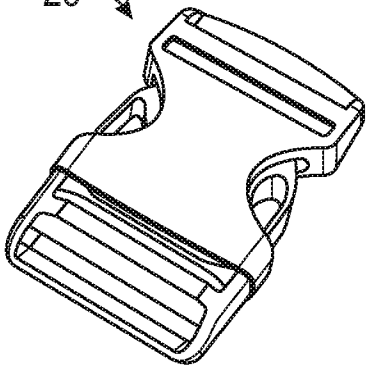
FIGS. 11*a*-11*c* are perspective views of buckles of the seat cover system of FIG. 1.
Figure 11A:
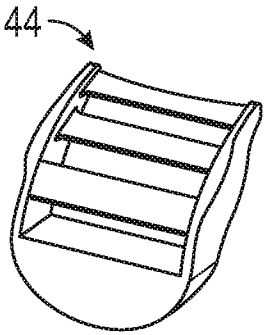
Figure 11C:
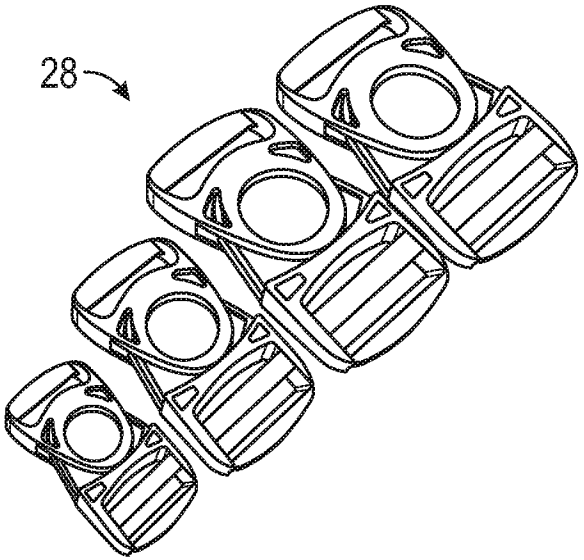
Figure 14:
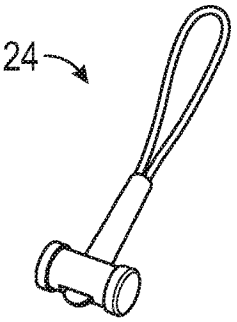
FIG. 14 is a perspective view of a zipper pull of the seat cover system of FIG. 1.
Figure 15:
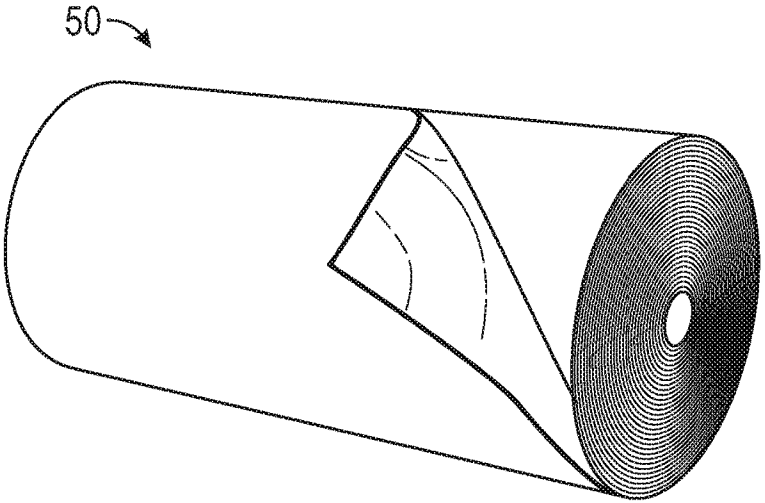
FIG. 15 is a perspective view of insulation material to be positioned with the seat cover system of FIG. 1.
Figure 13:
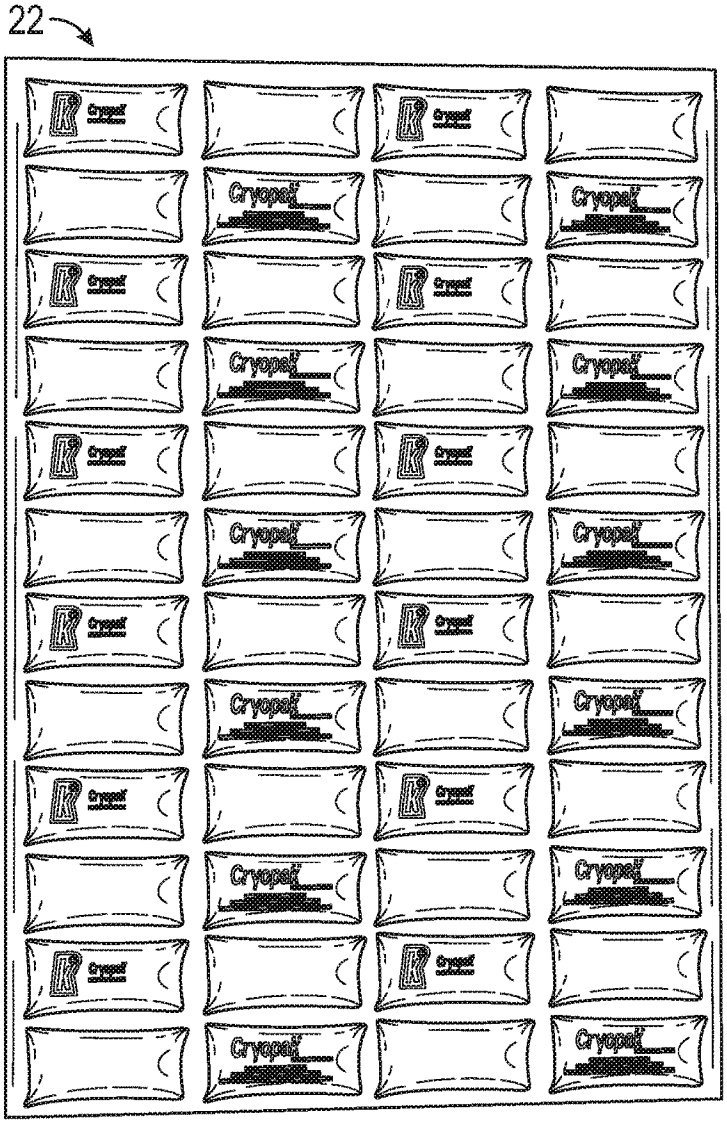
FIG. 13 is a front view of a cooling pack of the seat cover system of FIG. 1.

FIGS. 11*a*-11*c* illustrate buckles of the seat cover system 10. More specifically, FIG. 11*a* illustrates, one of the adjusters 44, FIG. 11*b* illustrates one of the coupling buckles 26, and FIG. 11*c* illustrates the swivel buckles 28. FIG. 12 illustrates a portion of the main body 12 of the seat cover system 10. FIG. 13 illustrates the cooling pack 22 of the seat cover system 10, which is carried in the main body 12. FIG. 14 illustrates the zipper pull 24 of the seat cover system 10. FIG. 15 illustrates insulation material 50 to be positioned with the seat cover system 10 and form a pouch for receiving the cooling pack 22.

In some embodiments, testing requirements for the seat cover system 10 are as follows: POM: 50 kg, reciprocation cycles: 500 cycles, salt spray: 5.5+/−1.0 PH (white); for zippers, 5.75+/−1.75 pH (colored materials)-no tolerance, UV colorfastness: 3.5 for non-white, and seam allowance of ⅜" minimum.

Figures 16A, 16B, 16C:
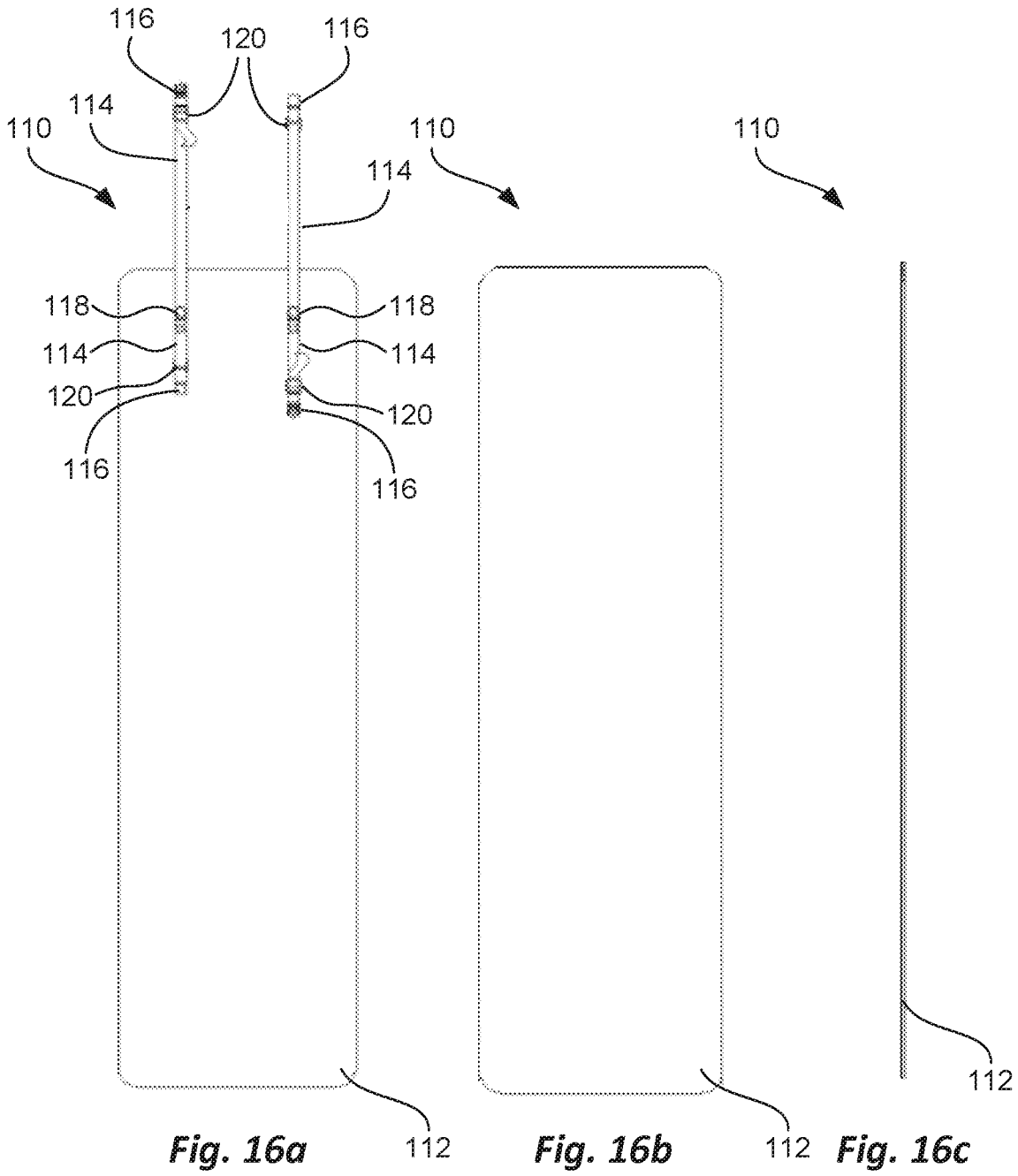
FIGS. 16*a*-16*c* are views of a seat cover system, according to another exemplary embodiment of the present disclosure, in a flattened configuration.

FIGS. 16*a*-16*c* illustrate a seat cover system 110, or components thereof, according to another exemplary embodiment of the present disclosure. The seat cover system 110 is configured to be detachably coupled to a seat, more specifically and for example, a lounge seat. The seat cover system 110 may have dimensions of about 1905 cm×560 cm×10 cm or various other dimensions. In certain embodiments, the seat cover system 110, except for the above dimensions, has substantially similar features and is used in a substantially similar manner to the seat cover system 10. More specifically, in some embodiments the seat cover system 110 includes a main body 112, which may be constructed of pack cloth or other weather-resistant material, a zipper (not shown; the same or substantially similar to the zipper 14 of the seat cover system 10), a plurality of straps 114 (FIG. 16*a*), such as straps constructed of a 1.5" or 38 mm black polyester webbing, webbing components (not shown; the same or substantially similar to the webbing components 18 of the seat cover system 10), a side orientated flap (not shown; the same or substantially similar to the upper flap 20 of the seat cover system 10), a refreezable or recoolable cooling pack (not shown; the same or substantially similar to the cooling pack 22 of the seat cover system 10), a zipper pull (not shown; the same or substantially similar to the zipper pull 24 of the seat cover system, with a side orientation rather than on the top of the seat cover system 10), coupling buckles 116, swivel connectors or buckles 118, and adjusters 120. According to some embodiments, stitching may match the main body 112 of the seat cover system 110 and may have eight stitches per inch. The stitching may be nylon, and the seat cover system 110 may be individually packed in a poly bag.

In some embodiments, testing requirements for the seat cover system 110 are as follows: POM: 50 kg, reciprocation cycles: 500 cycles, salt spray: 5.5+/−1.0 PH (White); for zippers, 5.75+/−1.75 pH (colored materials)-no tolerance, UV colorfastness: 3.5 for non-white, and seam allowance of ⅜" minimum.

Figure 17:
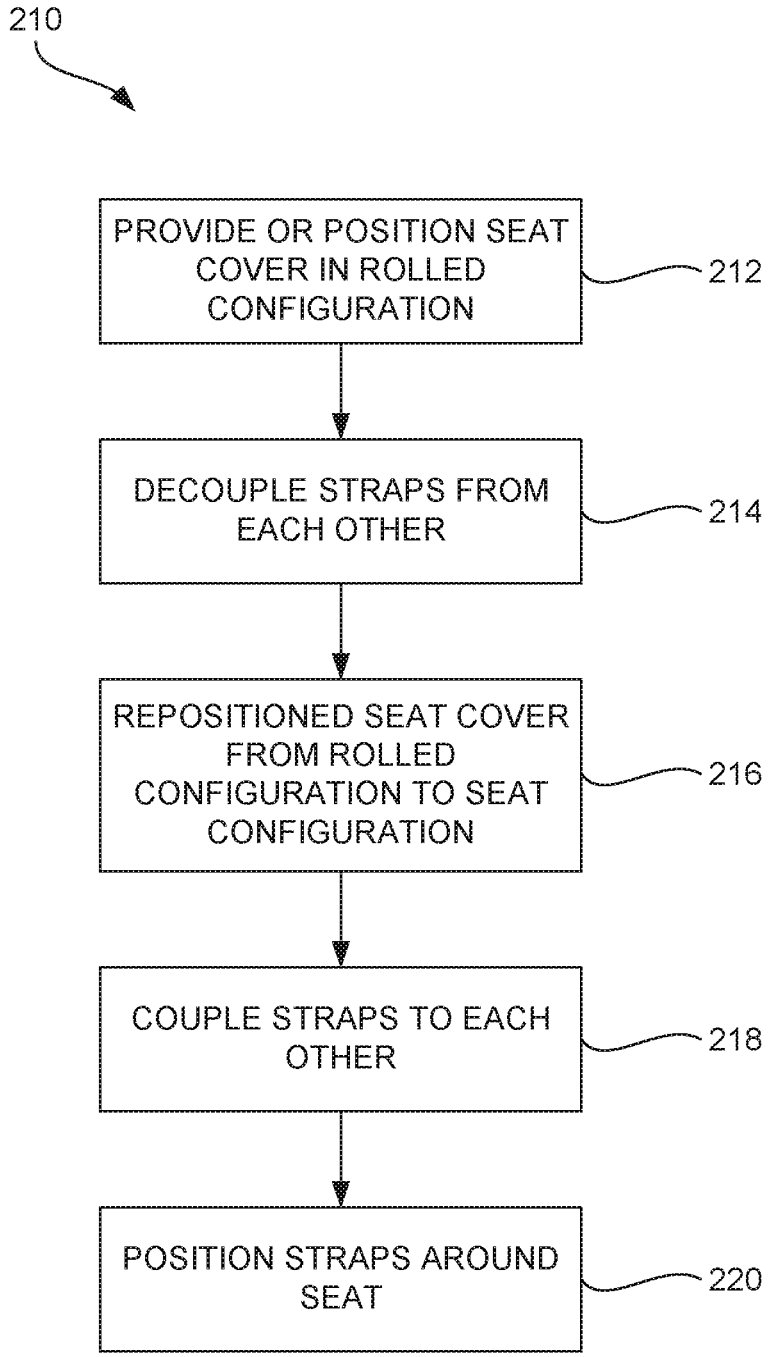
FIG. 17 is a flow diagram of a method for coupling a seat cover system to a seat, according to another exemplary embodiment of the present disclosure.

FIG. 17 shows a method 210 for coupling a seat cover system to seat, according to an exemplary embodiment of the present disclosure. The following description of the method 210 refers to the seat cover system 10 and components thereof as an example, although the method 210 may be used to couple other seat cover systems to seats, such as the seat cover system 110. The method begins at block 212 by providing or positioning the seat cover system 10 in a rolled configuration, and the straps 16 are coupled to each other to maintain the seat cover system 10 in the rolled configuration (for example, as shown in FIG. 8). More specifically, each upper strap 16*a*, 16*b* is coupled to one of the lower straps 16*c*, 16*d*. At block 214, the straps 16 are decoupled from each other, for example, by decoupling the coupling buckles 26. At block 216, the seat cover system 10 is repositioned from the rolled configuration to a seat configuration (for example, as shown in FIG. 1). In some embodiments, the upper straps 16*a*, 16*b* are reconfigured from a first configuration (for example, as shown with solid lines in FIG. 6) to a second configuration (for example, as shown with phantom lines in FIG. 6) by pivoting the straps 16*a*, 16*b* relative to the main body 12 via the swivel buckles 28. At block 218, the straps 16 are coupled, more specifically, the upper straps 16*a*, 16*b* are coupled to each other, and at block 220 the straps 16 are positioned around a seat, more specifically, the upper straps 16*a*, 16*b* are positioned around the seat. In certain embodiments, the method 210 further includes coupling each upper strap 16*a*, 16*b* to one of the lower straps 16*c*, 16*d* in the seat configuration to form carrying loops, and carrying the seat cover system 10 in the seat configuration via the carrying loops. Stated another way, the straps 16 are positioned around the arms of user to facilitate carrying the seat cover system 10 in the seat configuration.

Various other modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

What is claimed is:

1. A seat cover system for detachably coupling to a seat, the seat cover system comprising:

a main body comprising a top end, a bottom end, a first side, and a second side, a back portion, and a seat portion, the first side comprising a first gusset coupling the back portion and the seat portion, and the second side comprising a second gusset coupling the back portion and the seat portion; and a cooling pack carried in the main body;

wherein the seat cover system is configurable from a rolled configuration to a seat configuration and vice versa, the first gusset and the second gusset being configured to inhibit the seat cover system from reconfiguring from the seat configuration to a flat configuration.

2. The seat cover system of claim 1, further comprising a plurality of straps coupled to the main body.

3. The seat cover system of claim 2, wherein the plurality of straps are configured to extend around the seat to couple the seat cover system to the seat.

4. The seat cover system of claim 2, wherein the plurality of straps includes a first upper strap, a second upper strap, a first lower strap, and a second lower strap, and further comprising a plurality of swivel buckles including a first swivel buckle and a second swivel buckle, the first swivel buckle coupling the first upper strap to the first lower strap and the second swivel buckle coupling the second upper strap to the second lower strap, the first swivel buckle and the second swivel buckle permitting the first upper strap and the second upper strap to pivot relative to the main body such that (I) in the rolled configuration, the first upper strap detachably couples to the first lower strap and the second upper strap detachably couples to the second lower strap, and (II) in the seat configuration, the first upper strap detachably couples to the second upper strap to facilitate coupling the seat cover system to a seat.

5. The seat cover system of claim 1, wherein the back portion and the seat portion define an angle therebetween in a range of 100 degrees to 120 degrees.

6. The seat cover system of claim 1, further comprising an insulating pouch disposed in the main body and carrying the cooling pack.

7. A method of coupling a seat cover system to a seat, the seat cover system comprising a main body including a back portion and a seat portion, a plurality of straps coupled to the main body, and a cooling pack carried in the main body, the method comprising:

positioning the seat cover system in a rolled configuration;

coupling the plurality of straps to each other to maintain the seat cover system in the rolled configuration;

decoupling the plurality of straps from each other;

repositioning the seat cover system from the rolled configuration to a seat configuration;

coupling the plurality of straps to each other and positioning the plurality of straps around the seat; and folding down a forward end of the seat portion of the main body such that the seat portion is configured to contact backs of the legs and behind the knees of a person seated on the seat cover system.

8. The method of claim 7, wherein the plurality of straps comprises a plurality of upper straps and a plurality of lower straps, coupling the plurality of straps to each other to maintain the seat cover system in the rolled configuration comprises coupling each upper strap of the plurality of upper straps to one of the lower straps of the plurality of lower straps, and coupling the plurality of straps to each other and positioning the plurality of straps around the seat comprises coupling the plurality of upper straps to each other and positioning the plurality of upper straps around the seat.

9. The method of claim 7, wherein the seat cover system further comprises a plurality of swivel buckles coupling the plurality of straps to the main body.

10. The method of claim 9, further comprising, (1) after decoupling the plurality of straps from each other and (2) before coupling the plurality of straps to each other and positioning the plurality of straps around the seat, pivoting the plurality of straps relative to the main body via the plurality of swivel buckles.

11. A seat cover system for detachably coupling to a seat, the seat cover system comprising:

a main body comprising a top end, a bottom end, a first side, a second side, a back portion, a seat portion, and an inner chamber extending from the back portion to the seat portion, the first side comprising a first gusset and the second side comprising a second gusset; and a cooling pack carried in the inner chamber of the main body;

wherein the seat cover system is configurable from a rolled configuration to a seat configuration and vice versa, the first gusset and the second gusset being configured to inhibit the seat cover system from reconfiguring from the seat configuration to a flat configuration.

* * * * *